US008011438B2

(12) United States Patent
Edwards et al.

(10) Patent No.: US 8,011,438 B2
(45) Date of Patent: Sep. 6, 2011

(54) DOWNHOLE FLOW CONTROL WITH SELECTIVE PERMEABILITY

(75) Inventors: John E. Edwards, Ruwi (OM); Ronan Le Gloahec, Dubai (AE); Claude J. Vercaemer, Paris (FR); Philippe Hocquet, Vanves (FR); Pierre-Yves Corre, Eu (FR); Nitin Y. Vaidya, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1245 days.

(21) Appl. No.: 11/307,647

(22) Filed: Feb. 15, 2006

(65) Prior Publication Data

US 2006/0185849 A1 Aug. 24, 2006

Related U.S. Application Data

(60) Provisional application No. 60/655,358, filed on Feb. 23, 2005.

(51) Int. Cl.
*E21B 43/08* (2006.01)

(52) U.S. Cl. ..... 166/373; 166/230; 166/205; 166/302

(58) Field of Classification Search ..... 166/205, 166/227, 228, 230, 373, 60, 302
See application file for complete search history.

(56) References Cited

U.S. PATENT DOCUMENTS

| | | | | |
|---|---|---|---|---|
| 2,778,604 | A * | 1/1957 | Reistle, Jr. | 166/292 |
| 3,880,233 | A * | 4/1975 | Muecke et al. | 166/205 |
| 4,797,549 | A | 1/1989 | Ho et al. | |
| 4,858,691 | A * | 8/1989 | Ilfrey et al. | 166/278 |
| 5,287,923 | A * | 2/1994 | Cornette et al. | 166/278 |
| 5,372,200 | A | 12/1994 | Merrill, Jr. | |
| 5,901,789 | A * | 5/1999 | Donnelly et al. | 166/381 |
| 5,957,205 | A | 9/1999 | Bohme | |
| 5,980,745 | A * | 11/1999 | Voll et al. | 210/497.01 |
| 6,015,011 | A | 1/2000 | Hunter | |
| 6,311,774 | B1 | 11/2001 | Brockman et al. | |
| 6,505,682 | B2 | 1/2003 | Brockman | 166/250.15 |
| 6,672,385 | B2 | 1/2004 | Kilaas et al. | |
| 7,234,533 | B2 | 6/2007 | Gambier | |
| 7,387,165 | B2 | 6/2008 | Lopez de Cardenas et al. | |
| 7,562,709 | B2 | 7/2009 | Saebi et al. | |
| 2002/0142919 | A1 * | 10/2002 | Constien | 507/100 |

(Continued)

FOREIGN PATENT DOCUMENTS

| | | | |
|---|---|---|---|
| EP | 1780565 | A3 | 5/2007 |

(Continued)

OTHER PUBLICATIONS

See English Abstract for Cite No. 5—JP10123373A.

*Primary Examiner* — Shane Bomar
*Assistant Examiner* — Robert E Fuller
(74) *Attorney, Agent, or Firm* — Trop, Pruner & Hu, P.C.; David G. Matthews

(57) ABSTRACT

An apparatus includes a base pipe and a fluid control material. The base pipe includes openings, and the fluid control material is mounted to the pipe to control fluid communication through the openings of the pipe. The fluid control material has a permeability that may be changed to selectively control the communication of well fluid through the openings.

16 Claims, 8 Drawing Sheets

U.S. PATENT DOCUMENTS

| | | | | |
|---|---|---|---|---|
| 2004/0035590 | A1* | 2/2004 | Richard | 166/384 |
| 2004/0144535 | A1* | 7/2004 | Kalman et al. | 166/278 |
| 2004/0159435 | A1* | 8/2004 | Plucheck et al. | 166/313 |
| 2005/0199401 | A1 | 9/2005 | Patel et al. | |
| 2005/0205263 | A1 | 9/2005 | Richard | |
| 2006/0108015 | A1 | 5/2006 | Price et al. | |
| 2006/0175065 | A1* | 8/2006 | Ross | 166/386 |
| 2007/0131434 | A1 | 6/2007 | MacDougall et al. | |
| 2007/0272411 | A1 | 11/2007 | Lopez De Cardenas et al. | |
| 2009/0126945 | A1 | 5/2009 | Sharma et al. | |

FOREIGN PATENT DOCUMENTS

| | | | | |
|---|---|---|---|---|
| GB | 2354271 | A | | 3/2001 |
| GB | 2421527 | A | | 6/2006 |
| GB | 2440061 | A | | 1/2008 |
| JP | 05131595 | A | * | 5/1993 |
| JP | 10-123373 | A | | 5/1998 |
| WO | 0146729 | A1 | | 6/2001 |
| WO | 2004022911 | A3 | | 3/2004 |
| WO | 2005014976 | A1 | | 2/2005 |
| WO | 2006003113 | A1 | | 1/2006 |

* cited by examiner

DOWNHOLE FLOW CONTROL WITH SELECTIVE PERMEABILITY

This application claims the benefit under 35 U.S.C. §119 (e) to U.S. Provisional Application Ser. No. 60/655,358, entitled "FLOW CONTROL," filed on Feb. 23, 2005.

BACKGROUND

The invention generally relates to flow control, and more particularly, the invention relates to controlling the permeability of a fluid control material to regulate the flow of well fluid.

A typical subterranean well includes various production zones from which well fluid is produced and communicated to the surface of the well through one or more production strings. As a more specific example, to produce well fluid from a horizontal, or lateral wellbore, a typical subterranean well may include a base pipe that extends into the lateral wellbore. At different segments of the pipe, radial openings are formed in the base pipe for purposes of allowing well fluid to flow from the surrounding formation(s) into the central passageway of the pipe. For each segment, a screen that is coaxial with the base pipe may circumscribe the pipe for purposes of preventing debris from entering the pipe's central passageway.

Over the lifetime of a well, one or more of the zones that were originally targeted for production may begin producing an undesirable amount of water. Therefore, it may become desirable to shut down production from such water-producing zones, as the zones are identified. A valve, such as a sleeve valve, may be installed in each zone for this purpose. However, valves such as sleeve valves may be relatively expensive and complex, and these valves may be subject to failure over the lifetime of the well.

Thus, there exist a continuing need for an arrangement and/or technique to address one or more of the problems that are set forth above as well as address possibly one or more problems that are not set forth above.

SUMMARY

In an embodiment of the invention, an apparatus includes a base pipe and a fluid control material. The base pipe includes openings, and the fluid control material is mounted to the pipe to control fluid communication through the openings of the pipe. The fluid control material has a permeability that may be changed to selectively control the communication of well fluid through the openings.

In another embodiment of the invention, a technique that is usable with a well includes covering openings in a base pipe with a fluid control material to create a fluid control assembly. The technique includes selectively performing an action to change a permeability of the fluid control material to control well fluid through the openings of the base pipe.

In yet another embodiment of the invention, a screen assembly that is usable with a well includes a pipe and strands that are located on the exterior of the pipe. The pipe includes a wall that surrounds a passageway of the pipe and also includes openings in the wall. The strands are located in the proximity of the openings. Each strand includes a swellable core that is enclosed by a protective layer so that when the protective layer of strands are removed, the cores swell in the presence of well fluid to substantially impede communication through the openings of the pipe.

Advantages and other features of the invention will become apparent from the following drawing, description and claims.

DETAILED DESCRIPTION

Figure 1:
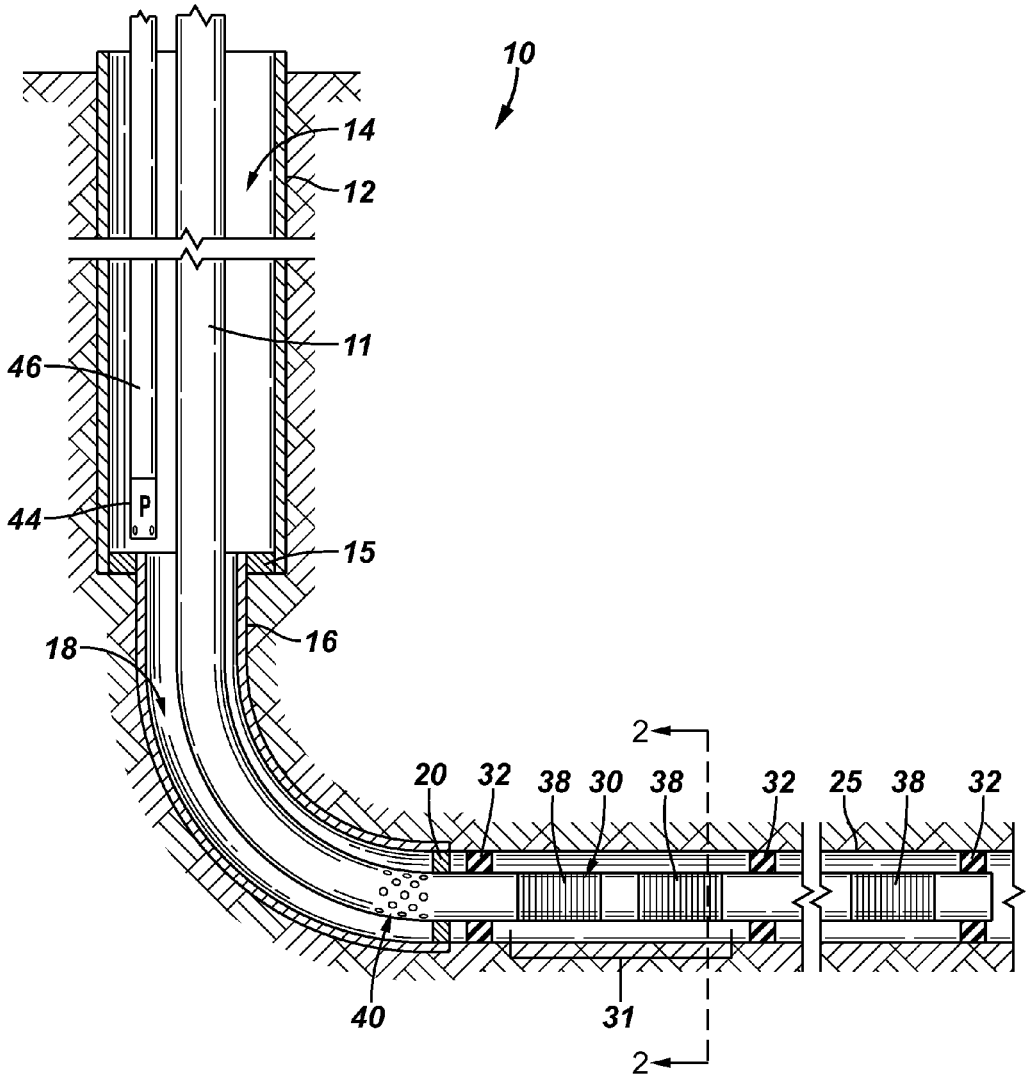
FIG. 1 is a schematic diagram of a subterranean well according to an embodiment of the invention.

Referring to FIG. 1, an embodiment 10 of a subterranean well in accordance with the invention includes a main wellbore section 14 that is lined by a casing sting 12. A casing string hanger 15 that is located at the bottom of the casing string 12 supports a casing string 16 that has a smaller inner diameter than the casing string 12. The casing string 16 hangs from the hanger 15 and extends into a smaller diameter wellbore section 18 that is located below the wellbore 14. The wellbore section 18 may transition into an uncased horizontal, or lateral, wellbore section 25. As depicted in FIG. 1, in some embodiments of the invention, a string 11 extends from the surface of the well into the lateral wellbore section 25. A seal 20 is formed between the interior of the casing string 16 and the exterior surface of the string 11.

In some embodiments of the invention, a logging tool may be inserted into the well (through the central passageway of the string 11) for purposes of measuring the production from the various zones along the lateral wellbore. After the logging operation, another tool (described below) may be run in the string 11 for purposes of controlling which zones of the lateral wellbore 25 are shut off (due to a measured high level of water production) or continue to produce.

In some embodiments of the invention, downstream of the screen assembly 30, the string 11 includes openings 40 in the wall of the string 11 to permit well fluid that is received into the central passageway of the screen assembly 30 to flow into the annular space that is located outside of the string 11. As depicted in FIG. 1, in some embodiments of the invention, a pump 44 pumps the well fluid received in this annular space to the surface of the well 10 via a production string 46.

Turning now to the specific details of the screen assembly 30, in some embodiments of the invention, the screen assembly 30 extends into various production zones of the lateral wellbore section 25. Initially, these zones may be designated for production. However, the designation of production zones may change over time, as one or more of the zones may produce unacceptable levels of water. Thus, the screen assembly 30 may extend into zones from which well fluid is to be produced and other zones from which well fluid is not to be produced. FIG. 1 depicts a particular production zone 31 of the lateral wellbore section 25 in accordance with an embodiment of the invention described below. It is understood that in accordance with various embodiments of the invention, the lateral wellbore section 25 may contain other such production zones 31. Furthermore, although one lateral wellbore and string assembly 30 is disclosed in FIG. 1, it is understood that the depicted well is for purposes of example only, as the techniques and systems that are described herein may apply to multilateral wells.

Coinciding with the production zone 31, the screen assembly 30 includes packers 32 that are located on either side of the production zone 31. When set, the packers 32 form a seal between an exterior of a base pipe (described further below) of the screen assembly 30 and the interior wall of the lateral wellbore section 25 to effectively isolate the production zone 31 from other zones.

The packers 32 may take on various forms, depending on the particular embodiment of the invention. For example, in some embodiments of the invention, the packers 32 may be inflatable packers, or may be hydraulically or mechanically-set packers that include annular elements and collars that compress the elements in between.

In other embodiments of the invention, each packer 32 may be formed from a rubber material that contains a high concentration of salt that does not leach out with time. By the process of water hydration, which is driven by osmotic pressure that is established by a salinity gradient between the rubber material and the formation water, the rubber material of the packer 32 swells. The swelling, in turn, seals off the region between the base pipe and the adjacent inner wellbore wall.

As depicted in FIG. 1, in some embodiments of the invention, the screen assembly 30 is divided into segments 38 that regulate the flow well fluid into the base pipe. One or more segments 38 may exist between adjacent packers 32. Thus, if it is determined at some point during the lifetime of the well, that near a particular segment 38 the well is producing an unacceptable level of water, then all of the corresponding segments 38 between the packers 32 are activated (as described below) to shut off this portion of the well by blocking the flow of well fluid into the base pipe.

For purposes of achieving this control, in some embodiments of the invention, each segment 38 includes a fluid control material that is remotely and selectively activated from the surface of the well for purposes of regulating the flow into the base pipe.

Figure 2:
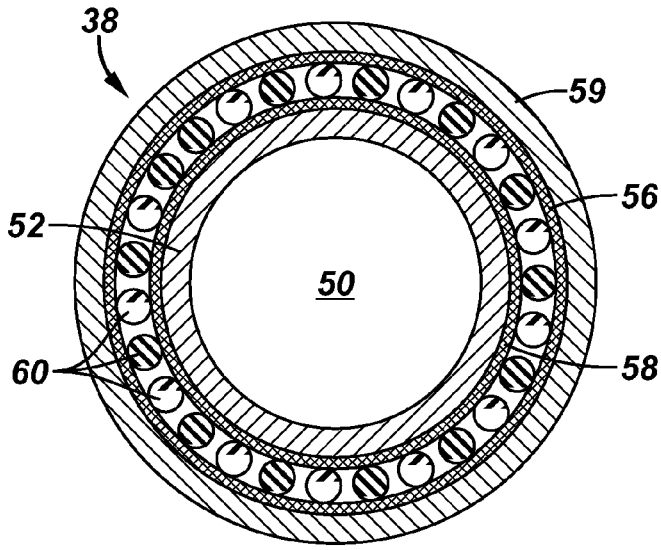
FIG. 2 is a cross-sectional view taken along line 2-2 of FIG. 1.

As a more specific example, FIG. 2 depicts a cross-sectional view of an exemplary segment 38 in accordance with an embodiment of the invention. The segment 38 includes a fluid control material that is formed from composite strands 60 (for the embodiment of the invention) and extends around which are located on the exterior of a base pipe 52 (of the segment 38). As a more specific example, in some embodiments of the invention, the composite strands 60 may be formed into a mesh that extends around the exterior surface of the base pipe 52. In their unexpanded or unswollen states (depicted in FIG. 2), the composite strands 60 do not impede the flow of well fluid into radial openings (not shown in FIG. 2) of the base pipe 52 and on into a central passageway 50 of the base pipe 52. However, when activated (as further described below), the inner cores of the composite strands 60 swell to substantially reduce, if not close off, gaps that exist between the strands 60. Due to the swelling, well fluid is prevented from flowing into the radial openings of the base pipe 52; and thus, well fluid is prevented from flowing into the central passageway 50 of the base pipe 52 for the particular segment 38.

In addition to the base pipe 52 and the surrounding fluid control material that is formed from the composite strands 60, in some embodiments of the invention, the segment 38 may include a screen jacket 59 that surrounds the composite strands 60 and is coaxial with the longitudinal axis of the segment 38. As a more specific example, in some embodiments of the invention, the screen jacket 59 may be a wire wrap screen jacket, although other screen jackets may be used, in other embodiments of the invention. The screen jacket 59 is used for purposes of controlling the entry of debris (e.g., sand) into the openings of the base pipe 52. In completions in which sand control is not used, a shroud that contains predrilled holes may be used in place of the screen jacket 59.

Among the other features of the segment 38, in some embodiments of the invention, an inner wire mesh 58 may be located between the composite strand 60 and the exterior of the base pipe 52. Furthermore, in some embodiments of the invention, an outer wire mesh 56 may be radially located between the composite strands 60 and the interior of the screen jacket 59. As described further below, a function of the inner 58 and outer 56 meshes is to confine the swelling of the cores of the composite strands 60 to limit the radial component of the swelling so that gaps (located tangentially to the gaps) between adjacent strands 60 are closed in the swelling, as further described below.

Figure 3:
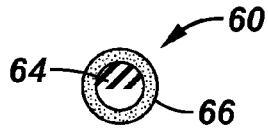
FIG. 3 is a cross-sectional view of a composite strand used in a fluid control material to control the flow of well fluid into a base pipe according to an embodiment of the invention.

Referring to a cross-section of the composite strand 60 that is depicted in FIG. 3, in some embodiments of the invention, the composite strand may include an inner core, such as a rubber strand 64, that swells when exposed to formation water that is surrounded on its exterior by a protective layer 66 that protects the rubber strand 64 from being exposed to formation water. The rubber strand 64 may, in some embodiments of the invention, contain a relatively high concentration of salt that does not leach out with time. Due to osmotic pressure that is caused by water hydration from the salinity gradient between the rubber and the formation water, the rubber strand 64 expands when exposed to the formation water. Thus, the rubber strand 64 may be made of the same material as the packers 32, in some embodiments of the invention.

As long as the rubber strand 64 is surrounded by the protective coating 66, the rubber strand 64 is not exposed to water and thus, does not expand. Therefore, in this protected state, well fluid flows between the strands 60 and into the radial openings of the base pipe 52. However, upon removal of the protective coating 66, the rubber strands 64 are exposed to formation water, an exposure that causes the strands 64 to expand to restrict and possibly close (depending on the particular embodiment of the invention) the communication of well fluid into the radial openings of the base pipe 52 inside the strands 64.

Figure 4:
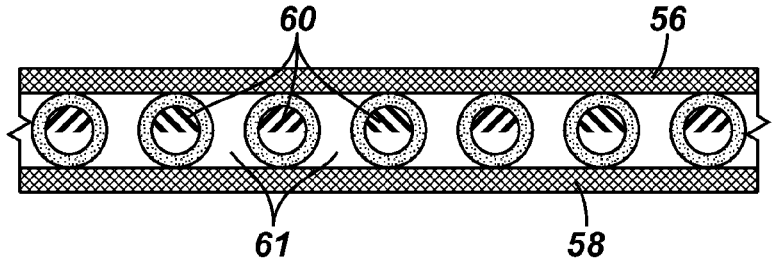
FIGS. 4 and 5 illustrate swelling of the inner cores of composite strands of a fluid control material according an embodiment of the invention.
Figure 5:
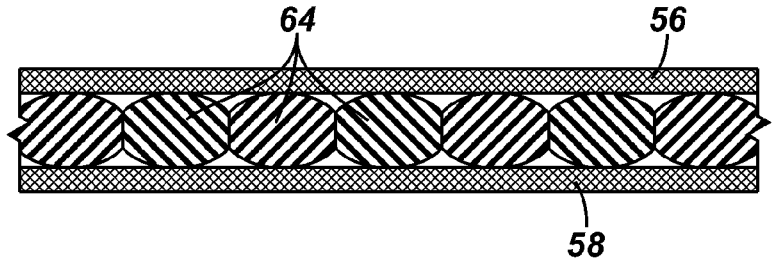

To further illustrate the states of the composite strands 60, FIG. 4 depicts a cross-section of the strands 60 between the inner 58 and outer 56 meshes. As shown, in the unexpanded state, gaps 61 exist between adjacent composite strands 60. Therefore, well fluid flows through the inner 58 and outer 56 meshes through the gaps 61 and into the openings of the base pipe 52. However, upon activation (described further below) of the composite strand 60, the protective coating 66 (FIG. 3) is removed, a removal that exposes the rubber strands 64 to expand to close the gaps, as depicted in FIG. 5. FIG. 5 also depicts the confinement of the swelling by the inner 58 and outer 56 meshes so that the swelling occurs primarily in tangential directions to close the gaps 61.

Figure 6:
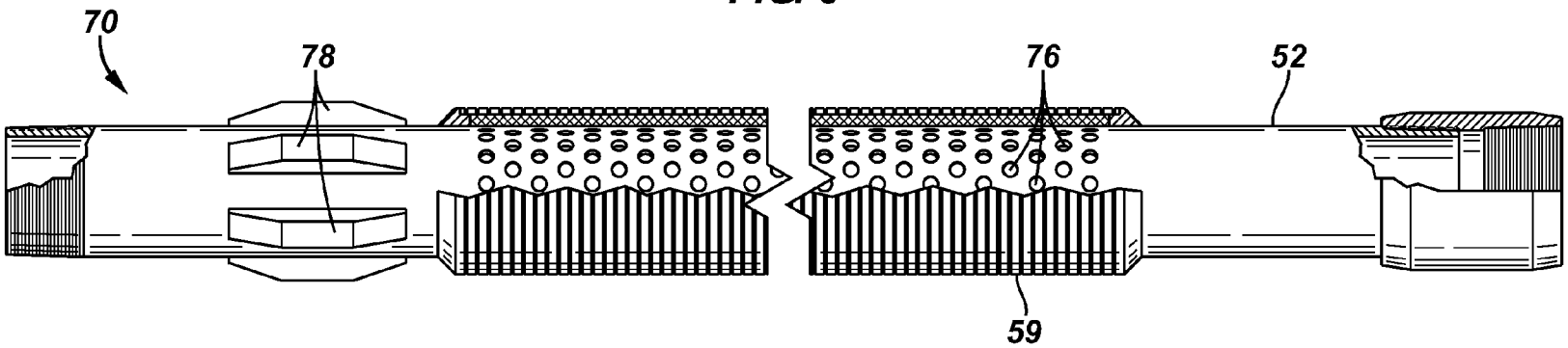
FIG. 6 depicts a portion of a screen assembly according to an embodiment of the invention.

FIG. 6 depicts a portion 70 of the segment 38 in accordance with an embodiment of the invention for purposes of illustrating a possible form for the base pipe 52. The composite strands 60 are not depicted in FIG. 6. As shown in FIG. 6, the base pipe 52 includes radial openings 76 for purposes of communicating well fluid between the outside of the base pipe 52 and its central passageway 50 (see FIG. 2). The openings 76, in turn, are surrounded by the screen jacket 59. As also depicted in FIG. 6, in some embodiments of the invention, the segment 38 (as depicted in the portion 70) may include centralizers 78 that radially extend from the exterior of the base pipe 52 for purposes of centering the segment 38 in the lateral wellbore section 25 (see FIG. 1).

Figure 7:
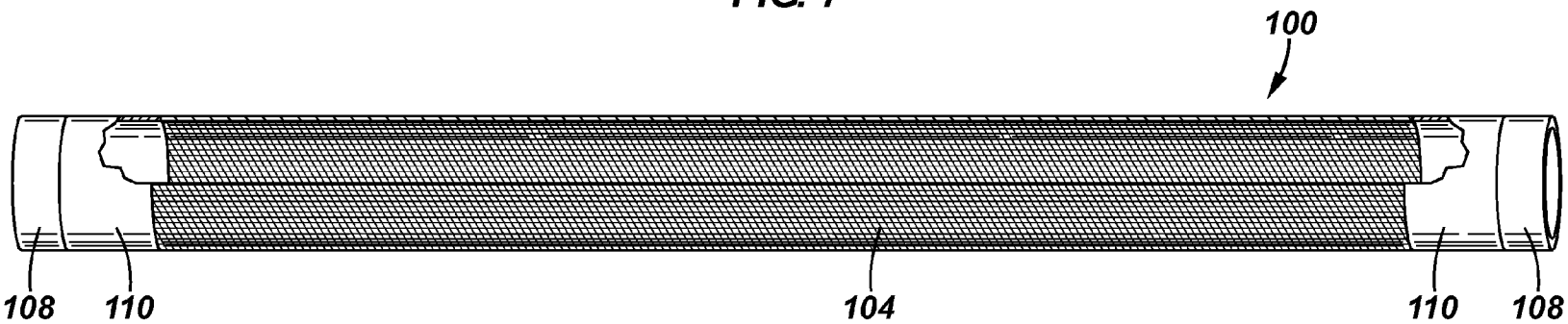
FIG. 7 is a schematic diagram of an assembly to be used with the screen assembly of FIG. 6 for purposes of controlling fluid flow into a base pipe according to an embodiment of the invention.

In some embodiments of the invention, the composite strands 60 may be assembled as part of a cartridge 100 (FIG. 7) of the segment 38. Referring to FIG. 7, the cartridge 100 includes a cylindrical mesh 104 (i.e., the fluid control material) of the composite strands 60, the mesh 104 is generally concentric with the longitudinal axis of the element 38 (see FIG. 1). The cylindrical mesh 104 is inserted between the screen jacket 59 and the base pipe 52, as previously described above in connection with FIG. 2. In some embodiments of the invention, the composite strands 60 may be arranged in a single wrap with a gap between each strand 60. Although not depicted in FIG. 7, the inner 58 and outer 56 meshes keep the strands 60 in place and keeps the cartridge 100 stiff during assembly of the cartridge 100 in addition to controlling the swelling extrusion of the strands when the swelling process is activated. In some embodiments of the invention, the inner 58 and outer 56 meshes perform three functions: a first function of keeping the cartridge 100 stiff during assembly, a second function of stopping the swelling material extruding radially; and a third function of protecting the strands from erosion by deflecting and scattering any formation induced jets of produced fluid.

Among the other features of the cartridge 100, in some embodiments of the invention, the cartridge 100 includes a heat resistant and fluid impermeable material that is located at either end of the cylindrical mesh 104 for purposes of protecting the mesh 104 from the heat that is generated during welding of the screen jacket 59 to the base pipe 52. As shown in FIG. 7, the material 110 may radially surround the base pipe 52 and may be located to separate each end of the cylindrical mesh 104 from a steel ring 108. The steel rings 108 are located at each end of the element 38 (see FIG. 1) for purposes of connecting the screen jackets 59 to the base pipe 52. Thus, the screen jacket 59 is mounted over the cartridge 104, and the ends of the screen jacket 59 extend over the steel rings 108. In some embodiments of the invention, each steel ring 108 is welded to one end of the screen jacket 59 and is also to the exterior surface of the base pipe 52. Thus, the steel rings 108 are located at the end of the cartridge 104 to centralize the screen jacket 59; and due to the welding seals at the ends of the cartridge 104 due to the welding of the screen jacket 59 to the steel rings 108, when the swelling material is activated, the entire screen jacket 59 becomes impermeable. It is noted that in other embodiments of the invention, midpoint steel rings may also be used to protect the cartridge 104 from being unduly compressed between the jacket screen 59 and the base pipe 52 when the screen assembly is run into a well that has a relatively high degree of curvature.

In some embodiments of the invention, the cartridge 104 requires no alteration of the base pipe 52 and screen jacket 59, apart from a reduction in size of the base pipe 52. Thus, the cartridge 104 preserves without compromise all of the functionality and the base pipe 52 and the screen jacket 59.

Figure 8:
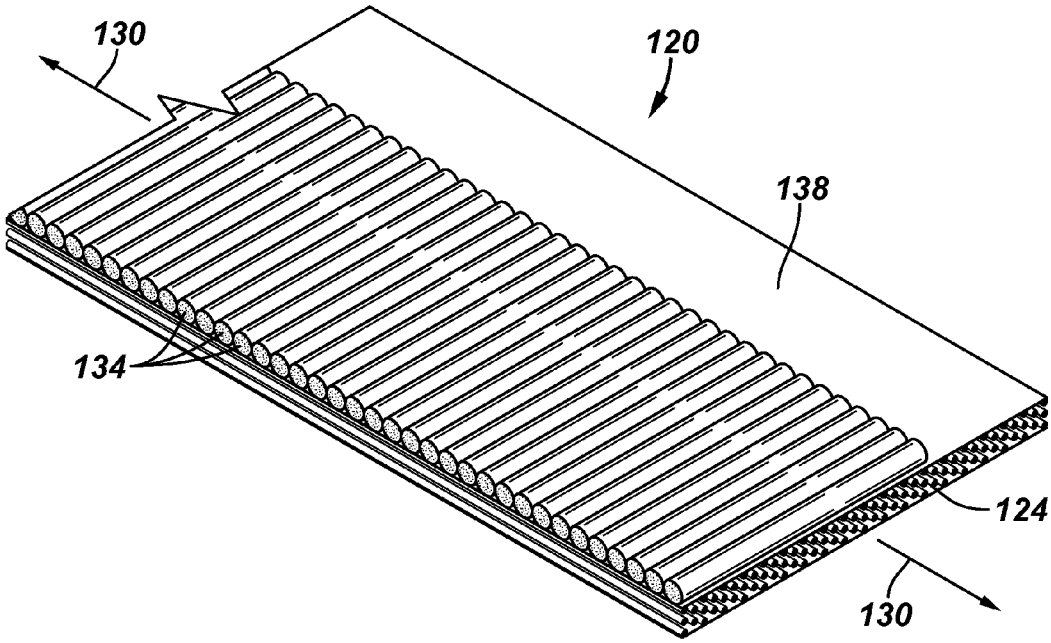
FIG. 8 is a perspective view of a tape used to form a protective layer of the fluid control material according to an embodiment of the invention.

Referring to FIG. 8, in some embodiments of the invention, the protective coating 66 (FIG. 3) may be formed by a reinforced and adhesive-backed polymer tape, such as polyolefin. With the resultant composite strand 60, heat may be selectively applied to melt/soften the polymer tape for purposes of exposing the rubber strands 64 to formation water. In embodiments where semicrystalline plastics are used as the protective coating 66, the temperature to melt the tape needs to be above the melting point of the plastic, and in amorphous plastics, the temperature needs to be above the glass transition temperature. More specifically, in some embodiments of the invention, the melting point and/or glass transition temperature of the polymer is above the temperature of the well where the segment 38 is installed. For example, polyethylene melts around 135° Celsius (C.), and an ethylene octane copolymer melts around 55° C. This allows a heating element to be lowered downhole to melt/soften the tape for purposes of exposing the rubber strands 64 to close off a particular segment 38, as further described below.

In some embodiments of the invention, the polymer tape is made of polyolefin that contains an outer cotton (or an even tougher material) reinforcing that protects the tape from erosion due to moving well fluids. Furthermore, in some embodiments of the invention, the cotton is arranged in short pieces that are glued perpendicular to the tape to avoid impeding the expansion of the rubber strands 64.

As a more specific example, as depicted in FIG. 8, a polyolefin tape 124 may be arranged along a tape direction 124 that is generally transverse to the axis along which the composite strands 60 extend. Cotton segments 134 are also arranged perpendicular to the tape direction 130. Thus, the tape 124 may be applied in overlapped layers around the composite strand 60. As depicted in FIG. 8, the cotton strands 134 do not extend to the edge of the tape 124, leaving an uncovered portion 138 for purposes of tape overlap.

Due to the above-described arrangement, it is possible that the presence of short cotton pieces and polymer residue from the tape may be present when the rubber strands 64 expand. However, the seal that is formed by the swollen rubber strands 64 does not have to be a perfect seal, in some embodiments of the invention. More specifically, the pressure difference from toe to heel in horizontal wells is typically less than one bar, so that between the screen segments, the pressure difference is even less. Therefore, the use of the swollen rubber strands "damages" the screens where water is largely being produced. The sand screen seals do not need to be better then the annular seals formed by the packers 32 (see FIG. 1), in some embodiments of the invention.

Figure 9:
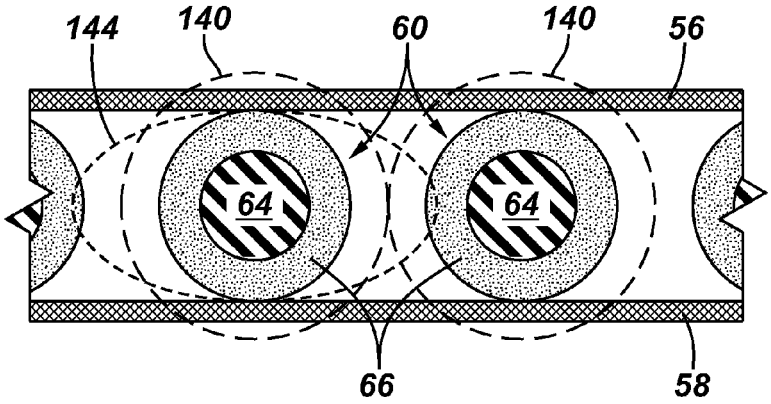
FIG. 9 is a cross-sectional view illustrating swelling of the cores of the composite strands when the tape of FIG. 8 is used as a protective layer according to an embodiment of the invention.

FIG. 9 depicts the potential swelling patterns of two adjacent composite strands 60 when the outer protective layer 66 is removed (such as by heat, for example). More specifically, the circle 140 depicts the cross-sectional diameter of the composite strand 60 when swollen to 150%. When constrained between the inner 58 and outer 56 meshes, however, each rubber strand 64 expands in an elliptical pattern 144. As can be seen from FIG. 9, the elliptical pattern 144 enhances the seal that is formed between adjacent rubber strands 64.

Figure 10:
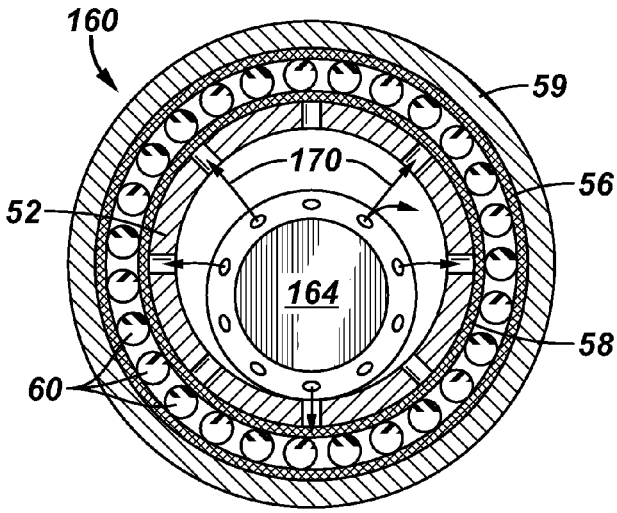
FIG. 10 is a cross-sectional view of the screen assembly depicting use of a deployed heating tool according to an embodiment of the invention.

In some embodiments of the invention, heat may be used to melt the protective layer 66 (see FIG. 3), such as the above-described polyolefin layer, for purposes of exposing the rubber strand 64 to formation water and thus, closing off a particular segment 38 from receiving well fluid from outside the segment. As a more specific example, in some embodiments of the invention, wellbore fluids may be pumped from the wellbore, heated above 135° C. (i.e., the melting point of the polyolefin) and injected through the openings 76 in the base pipe 52. As a more specific example, FIG. 10 depicts a wireline-deployed heater 164 that contains the above-described heating element and constant volume pump, along with fluid injection nozzles. The wireline heater 164, as depicted in FIG. 10, injects heated streams 170 of fluid through holes in the base pipe 52 and through the composite strand 60. This heated fluid, in turn, melts the protective coatings 66 on the composite strands 60 to expose the corresponding rubber elements 64 to formation water so that elements 64 swell.

In some embodiments of the invention, the heater 164 may heat wellbore fluids above approximately 107° C. so that this heated fluid is injected through the holes 76 in the base pipe 52 for enough time to melt and dislodge the protective coatings 66 from the rubber elements 64. Thus, the moving and dislodging of the melted protective coatings 66 away from the rubber element 64 is an additional benefit of using a physical movement of hot fluid, rather than just using thermal conductivity from a heating tube, for example.

The wireline heater 164 may be moved from one segment 38 to the next for purposes of selectively closing or downwardly regulating the flow of well fluid into the base pipe 52 from the corresponding well zones.

It is noted that in some embodiment of the invention, the above-described heating operation is performed during well shut-in to avoid movement of wellbore fluids that may otherwise dissipate energy away from the protective coating 66. Furthermore, the above-described heating operation, in some embodiments of the invention, immediately follows a production logging job that identifies potential sources of water production. In some embodiments of the invention, both the logging and activation runs are performed through the string 11 (see FIG. 1).

Thus, in some embodiments of the invention, the base pipe holes 76 serve dual purposes, in that the holes 76 allow the production of reservoir fluid and also deliver activating fluid.

In general, regardless of the particular material used for the protective layer 66, the material has a melting point that is higher than the reservoir temperature but is lower than the swelling material being protected. The protective material melting point is within the heating capacity of an intervention device. Furthermore, the protective material has properties so that the material is not chemically attacked by either the reservoir fluids or by fluids that are introduced into the well.

Figure 11:
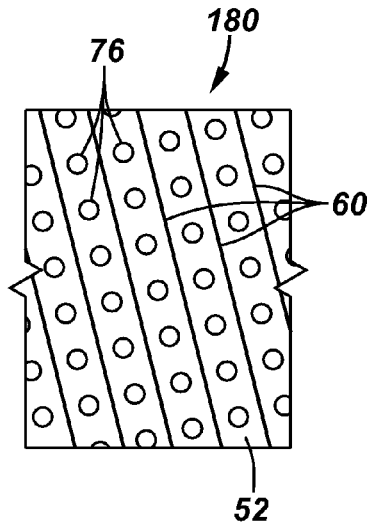
FIG. 11 illustrates the placement of the composite strands in relation to openings in the base pipe according to an embodiment of the invention.

Many variations are possible and are within the scope of the appended claims. For example, FIG. 11 depicts a flattened portion 180 of the base pipe 52 illustrating a relationship between the holes 76 of the base pipe 52 and surrounding composite strands 60. As shown, in some embodiment of the invention, the holes 76 may be spirally, or helically, arranged around the base pipe 52. With this arrangement, the composite strands 60 may also be helically wound around the exterior of the base pipe 52 to create gaps between adjacent composite strands 60. The openings 76, in turn, are aligned with these gaps for purposes of preventing erosion of the protective layers 66 of the composite strand 60 from produced or injected fluids.

As an example of another embodiment of the invention, the composite strands 60 may be wound directly on the base pipe 52, in the absence of the inner mesh 58. In this arrangement, the outer protective mesh 58 may be located between the composite strand 60 and the outer screen jacket 59.

In other embodiments of the invention, activation techniques other than heating may be used to activate a fluid control material. For example, depending on the particular embodiment of the invention, chemicals, radiation (a magnetic transmission, an electromagnetic transmission heat) or a mechanical technique may be used for purposes of activating a fluid control material to close off production through a particular segment. For example, as further described below, an acid may be used for purposes of removing the protective coatings 66 (see FIG. 3) of the composite strands 60, instead of heat.

Protective layers other than polyolefin tape may be used to protect the rubber strand 64 and may be sensitive to one of the above-described activation techniques. Additionally, it is noted that the core of the composite strand is not limited to the above-described rubber strand 64. Thus, in some embodiments of the invention, the rubber strand 64 may be replaced by another swellable material such as a hydrogel or a swelling polymer, as just a few examples.

As further examples of other embodiments of the invention, the protective coating 66 may be a time release coating (such as biodegradable polyethylene, SPI-TEK) and may be, in some embodiments of the invention, a heat shrink coating that dissipates and exposes the inner core of the composite strand to an activating agent. Furthermore, in some embodiments of the invention, the protective coating 66 may decompose/dissolve over time (such as such as BAK 1095 from Bayer which is a biodegradable polymer) and/or may become permeable (polyethylene filled with soluble salts) over time. Additionally, in some embodiments of the invention, a thermoplastic elastomer such as Ren-Flex, Hifax, Flexothene, Santoprene, Sarlink, Uniprene, Hifax, Trefsin, Vyram, Geolast, Alcryn, Rimplast, thermoplastic polyolefins such as Vistafles, Ferroflex, ETA and RTA, Deflex, Polytrope, Telcar, Kelburou, Vitacom TPO, Vestolen, thermoplastic polyurethane elastomers (TPU) may be used as the coating 66. Additionally, a melt processible rubber may be used as the protective coating 66. The protective coating 66 may also be from a semicrystalline polymer, such as polyethylene, an amorphous polymer, a metal or a ceramic in some embodiments of the invention.

Figure 12:
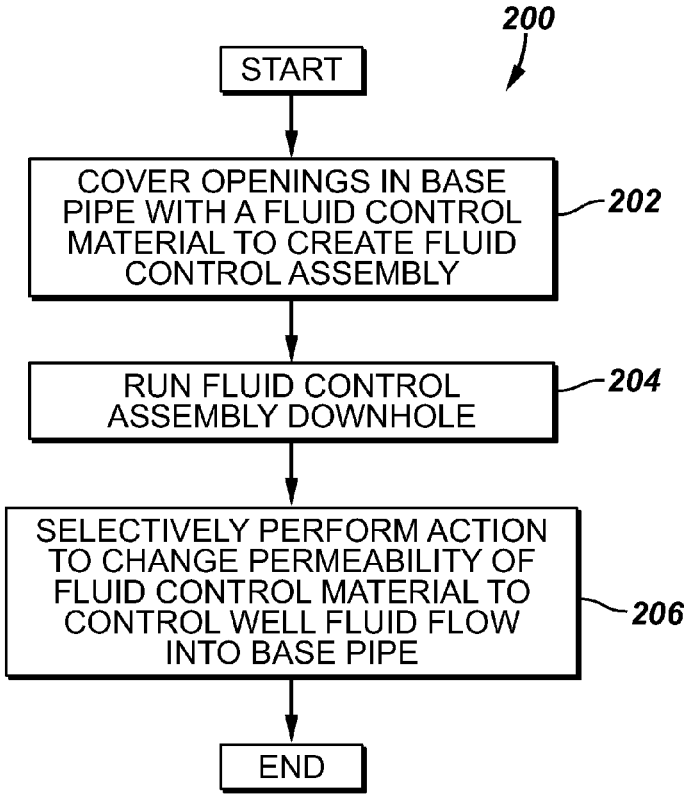
FIG. 12 is a flow diagram depicting a technique to control the flow of well fluid into a base pipe according an embodiment of the invention.

Referring to FIG. 12, thus, a technique 200 in accordance with the invention includes covering the openings in a base pipe with a fluid control material to create a fluid control assembly, as depicted in block 202. This fluid control assembly is then run downhole, as depicted in block 204. Subsequently, an action is selectively performed (block 206) to change the permeability of the fluid control material to control well fluid flow into the base pipe.

Figure 13:
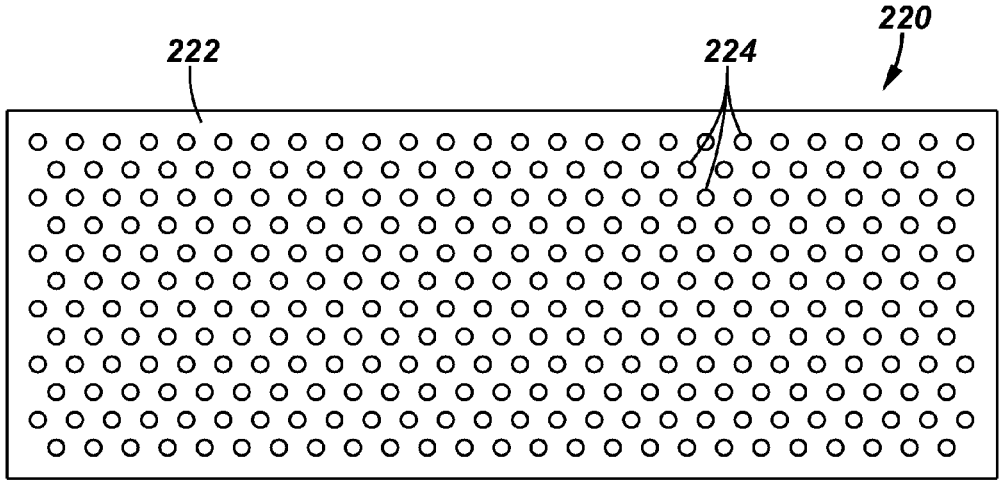
FIGS. 13 and 14 depict alternative fluid control materials according to different embodiments of the invention.

The above-described fluid control material contains composite strands (of a variety of different cores, coatings and combinations) that may be, for example, woven into a mesh. It is noted that the fluid control material may take other forms, in other embodiments of the invention. For example, referring to FIG. 13, in some embodiments of the invention, a material that contains holes or slots may be used in place of the strands 64. As a more specific example, FIG. 13 depicts a section 220 of a rubber sheath 222 that includes a sufficiently high density of holes 224. These holes 224 permit activation of the sheath 222, permit a sufficient flow through the holes 224 (and into the holes 76 of the base pipe 52) with a limited increase of pressure drop. The sheath 222 may be coated with a protective layer that is unaffected by production fluids but can be removed using high temperature or a chemical, such as acid. Similar to the above-described mesh 104 (FIG. 7) formed from the composite strands, the sheath 222 may be wrapped around the base pipe 52, with the screen jacket 59 surrounding the sheath 222. Alternatively, the sheath 222 may be wrapped around the screen jacket 59. The former arrangement permits easier access to activate the sheath 222 to remove its protective coating.

Figure 14:
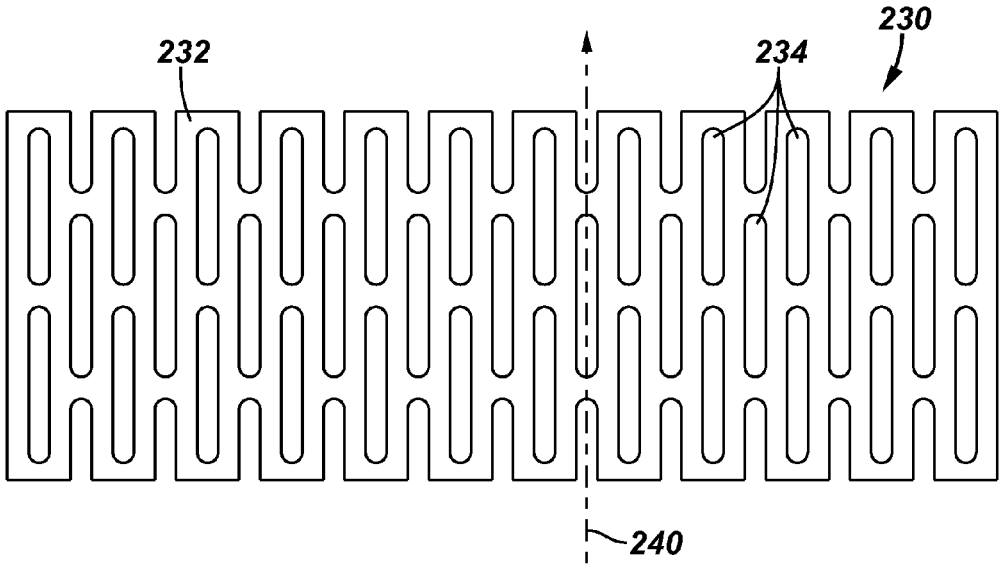

Although the holes 224 of the sheath 222 are round, other hole geometries may be used in other embodiments of the invention, as rubber is generally not compressible and forces may prevent the closure of perfectly round holes. Therefore, referring to FIG. 14, in accordance with another embodiment of the invention, a sheath may be formed from elongated holes or slots. More specifically, as depicted in a portion 230, a sheath 232 includes elongated slots 234. As shown in FIG. 14, the slots 234 may be generally aligned with an axis 240 that, in turn, may be generally aligned with longitudinal axis of the base pipe 52. Furthermore, the longitudinal slots 234 of a particular vertical alignment may be offset from the immediately adjacent next group of slots 234.

Figure 15:
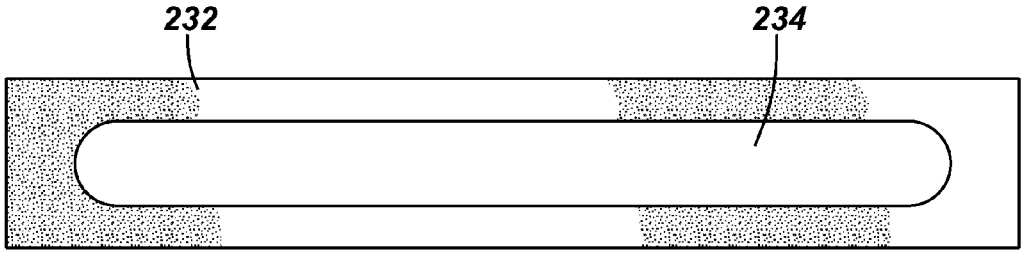
FIGS. 15 and 16 depict the effects of swelling on an elongated slot of the fluid control material of FIG. 14 according to an embodiment of the invention.
Figure 16:
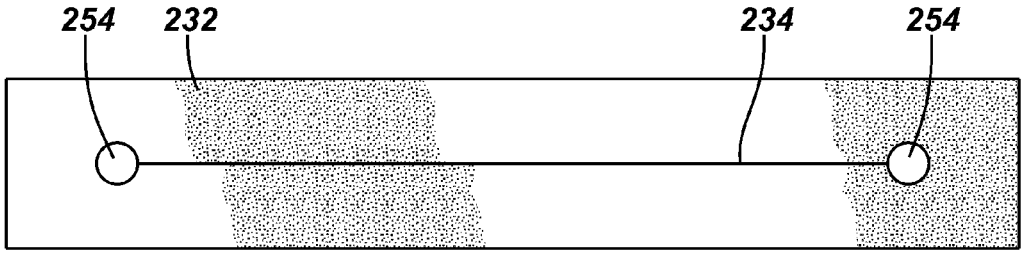

FIGS. 15 and 16 depict a particular elongated slot 234 before (FIG. 15) and after (FIG. 16) swelling of the sheath 232. As can be seen from FIG. 16, after the swelling of the sheath 232, the slot 234 is generally closed, with small holes 254 being located at the opposite ends of the original slot 234. It is noted that, in some embodiments of the invention, other solutions may be used to plug the holes 254 at the end of the slots.

As yet another example of another possible embodiment of the invention, one or more segments 38 may be reopened after the fluid control material has been activated to close off the production of well fluid through the segment(s) 38. For example, in some embodiments of the invention, a coil tubing-deployed jet blaster tool may reestablish hydraulic communication by cutting the swollen rubber strands (for the embodiments of the invention in which the fluid control material is formed from rubber strands, as described above) through the holes 76 in the base pipe 52. The holes in the outer 58 and inner 56 meshes pass the high pressure flow that performs the cutting. It is noted that other techniques may be used to remove the fluid control material, once activated, in the various other embodiments of the invention.

The flow control that is described herein also applies to a flow from the inside of the base pipe to a region outside of the base pipe. Thus, in accordance with some embodiments of the invention, the fluid control material may be used as a fluid diverter in water, effluent or steam injection applications (as just a few examples). Therefore, the techniques and systems that are disclosed herein are applicable to flows in either direction (radially inward or radially outward) through the fluid control material.

Figure 17:
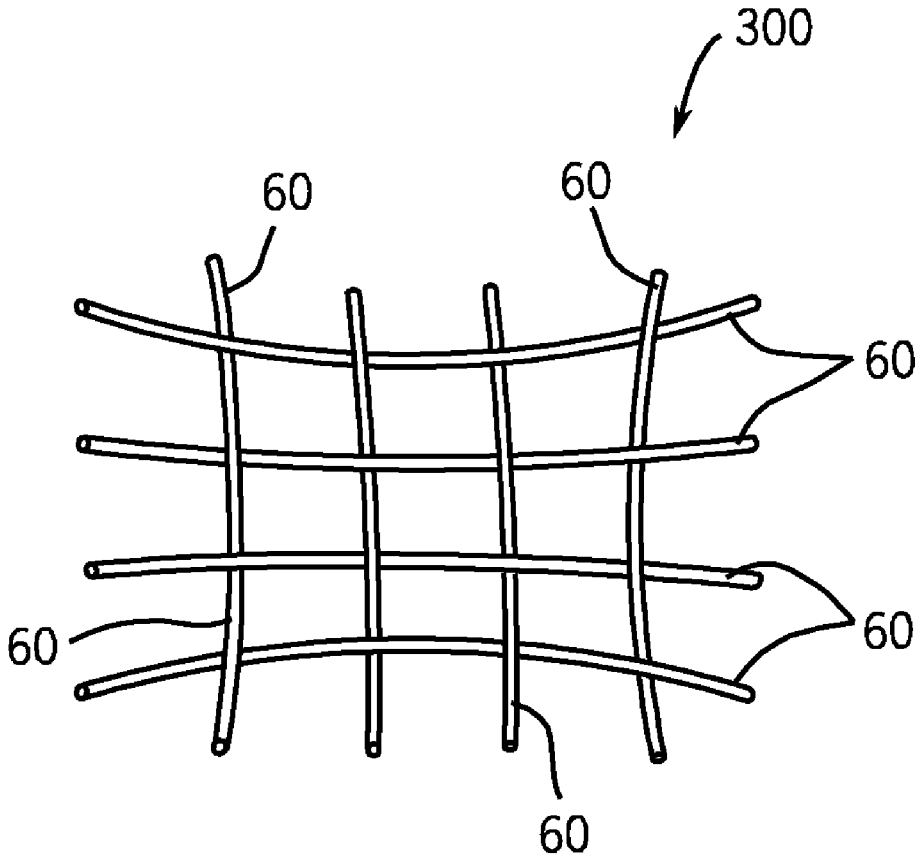
FIG. 17 is a perspective view of a mesh according to an embodiment of the invention.

Thus, in accordance with embodiments of the invention, an apparatus includes a base pipe, which includes openings; and a fluid control material that is mounted to the pipe to control fluid communication through the openings. The fluid control material has a permeability that may be changed to selectively control the communication of well fluid through the openings. Referring to FIG. 17, the fluid control material may include strands 60, which are woven into a mesh 300.

While the invention has been disclosed with respect to a limited number of embodiments, those skilled in the art, having the benefit of this disclosure, will appreciate numerous modifications and variations therefrom. It is intended that the appended claims cover all such modifications and variations as fall within the true spirit and scope of the invention.

What is claimed is:

1. An apparatus comprising:

a base pipe comprising openings;

a mesh disposed outside of the pipe and comprising interwoven strands of a fluid control material, each strand being adapted to selectively swell to control the communication of well fluid through the openings; and wherein the fluid control material comprises a protective coating being adapted to prevent the fluid control material from being activated and being adapted to be removed to permit activation of the fluid control material.

2. The apparatus of claim 1, wherein the fluid control material comprises at least one of the following:

a rubber element, a hydrogel and a polymer.

3. The apparatus of claim 1, wherein the protective material comprises at least one of the following:

a time release coating, a heat shrink coating, a thermoplastic elastomer, a melt processible rubber and a semicrystalline polymer.

4. The apparatus of claim 3, wherein the semicrystalline polymer comprises at least one of the following:

a polyethylene, an amorphous polymer, a metal and a ceramic.

5. The apparatus of claim 3, wherein the semicrystalline polymer comprises a composite material comprising one or more of the following: a polyethylene, an amorphous polymer, a metal and a ceramic.

6. The apparatus of claim 1, wherein the fluid control material is adapted to be activated by at least one of the following:

a chemical, a magnetic transmission, an electromagnetic transmission, heat and a mechanical action.

7. The apparatus of claim 1, wherein each strand being adapted to selectively swell in response to a selectively performed action.

8. A screen assembly usable with a well, comprising:

a pipe comprising a wall that surrounds a passageway of the pipe and openings in the wall; and strands located on the exterior of the pipe in the proximity of the openings and being woven into a mesh, each strand comprising a swellable core enclosed by a protective layer so that when the protective layers of strands are removed the cores swell in the presence of well fluid to substantially impede communication through the openings of the pipe.

9. The screen assembly of claim 8, wherein the swellable core comprises at least one of the following:

a rubber element, a hydrogel and a polymer.

10. The screen assembly of claim 8, wherein the protective layer comprises at least one of the following:

a time release coating, a heat shrink coating, a thermoplastic elastomer, a melt processible rubber and a semicrystalline polymer.

11. The screen assembly of claim 10, wherein the semicrystalline polymer comprises at least one of the following:

a polyethylene, an amorphous polymer, a metal and a ceramic.

12. The screen assembly of claim 10, wherein the semicrystalline polymer comprises a composite material comprising one or more of the following:

a polyethylene, an amorphous polymer, a metal and a ceramic.

13. A method usable with a well, comprising:

covering openings in a base pipe with a fluid control material comprising strands to create a fluid control assembly; and selectively performing an action to cause the strands to swell to change a permeability of the fluid control material to control well fluid flow through the openings, wherein the act of selectively performing the action comprises:

deploying a wireline conveyed tool downhole into the well;

drawing downhole fluid into an internal heating chamber of the tool; and pumping heated fluid from the internal heating chamber through the openings in the base pipe to the fluid control material to activate the material.

14. The method of claim 13, wherein the fluid control material comprises plastic-coated strands that melt in response to the heated fluid.

15. A method usable with a well, comprising:

covering openings in a base pipe with a fluid control material comprising strands woven into a mesh to create a fluid control assembly; and selectively performing an action to cause the strands to swell to change a permeability of the fluid control material to control well fluid flow through the openings, wherein the act of selectively performing the action comprises:

deploying a wireline conveyed tool downhole into the well;

drawing downhole fluid into an internal heating chamber of the tool; and pumping heated fluid from the internal heating chamber through nozzles in the tool to the fluid control material to activate the material.

16. The method of claim 15, wherein the fluid control material comprises plastic-coated strands that melt in response to the heated fluid.

* * * * *